US011453992B2

(12) United States Patent
Cui et al.

(10) Patent No.: US 11,453,992 B2
(45) Date of Patent: Sep. 27, 2022

(54) PILE FOUNDATION BEARING PLATFORM SETTLEMENT, REINFORCEMENT, LIFT-UP AND LEVELING STRUCTURE, AND CONSTRUCTION METHOD THEREOF

(71) Applicant: BEIJING HENGXIANG HONGYE FOUNDATION REINFORCEMENT TECHNOLOGY CO., LTD., Beijing (CN)

(72) Inventors: Xuedong Cui, Beijing (CN); Tengyue Cui, Beijing (CN); Jiguang Wu, Beijing (CN)

(73) Assignee: BEIJING HENGXIANG HONGYE FOUNDATION REINFORCEMENT TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 17/037,730

(22) Filed: Sep. 30, 2020

(65) Prior Publication Data

US 2021/0010223 A1 Jan. 14, 2021

Related U.S. Application Data

(63) Continuation of application No. PCT/CN2019/084388, filed on Apr. 25, 2019.

(30) Foreign Application Priority Data

Apr. 26, 2018 (CN) ..... 201810385674.6

(51) Int. Cl.
*E02D 27/12* (2006.01)
*E02D 35/00* (2006.01)

(52) U.S. Cl.
CPC ..... *E02D 35/005* (2013.01); *E02D 27/12* (2013.01); *E02D 2250/003* (2013.01)

(58) Field of Classification Search
CPC .... E02D 3/12; E02D 5/46; E02D 5/62; E02D 35/005; E02D 27/12; E02D 2250/003
See application file for complete search history.

(56) References Cited

U.S. PATENT DOCUMENTS 4,124,982 A * 11/1978 Fuller ..... E02D 3/10 405/232
4,370,077 A * 1/1983 Colgate ..... E21D 9/001 405/302.4

(Continued)

FOREIGN PATENT DOCUMENTS

CN 101886382 11/2010
CN 105464395 4/2016

(Continued)

*Primary Examiner* — Benjamin F Fiorello
(74) *Attorney, Agent, or Firm* — JCIP Global Inc.

(57) ABSTRACT

Provided are a pile foundation bearing platform settlement, reinforcement, lift-up and leveling structure and a construction method thereof. The structure includes a bearing platform and a plurality of pile foundations, a weak soil reinforcement layer under the bearing platform and a pile tip bearing stratum. The weak soil reinforcement layer forms a plurality of first grouting holes, and the first grouting hole extends through the bearing platform and communicates with the outside. The first grouting hole is used to perform primary grouting in the weak soil reinforcement layer. The pile tip bearing stratum forms a plurality of second grouting holes, and the second grouting hole extends through the weak soil reinforcement layer and the bearing platform, and communicates with the outside. The second grouting hole is used to perform secondary grouting in the pile tip bearing stratum.

9 Claims, 2 Drawing Sheets

(56) References Cited

U.S. PATENT DOCUMENTS

| | | | | |
|---|---|---|---|---|
| 5,800,090 | A * | 9/1998 | Goughnour | E02D 3/10 405/258.1 |
| 6,012,874 | A * | 1/2000 | Groneck | E02D 5/38 405/239 |
| 6,192,649 | B1 * | 2/2001 | Karim-Panahi | E02D 27/34 52/167.7 |
| 6,256,954 | B1 * | 7/2001 | Thooft | E02D 27/12 405/229 |
| 6,318,031 | B1 * | 11/2001 | Nakamura | E02D 27/34 52/167.1 |
| 6,672,015 | B2 * | 1/2004 | Cognon | E02D 5/36 52/169.1 |
| 7,048,473 | B2 * | 5/2006 | Takemiya | E01C 3/06 405/231 |
| 7,073,980 | B2 * | 7/2006 | Merjan | E02D 5/28 405/231 |
| 9,328,474 | B2 * | 5/2016 | Arya | E02D 27/50 |
| 10,161,096 | B2 * | 12/2018 | Masse | E02D 7/22 |
| 10,577,771 | B2 * | 3/2020 | Jullienne | E02D 27/38 |
| 2006/0013658 | A1 * | 1/2006 | Erdemgil | E02D 3/12 405/266 |
| 2008/0253845 | A1 * | 10/2008 | Takeuchi | E02D 27/44 405/233 |
| 2012/0163923 | A1 * | 6/2012 | Erdemgil | E02D 27/02 405/259.1 |
| 2014/0017015 | A1 * | 1/2014 | Hakkinen | E02D 5/46 405/233 |
| 2016/0362901 | A1 * | 12/2016 | Tabatabai | E04G 23/0203 |
| 2018/0016765 | A1 * | 1/2018 | Baldwin | E02D 37/00 |
| 2018/0044907 | A1 * | 2/2018 | Hu | E02D 7/00 |
| 2019/0186095 | A1 * | 6/2019 | Eddie | E02D 3/12 |
| 2021/0002848 | A1 * | 1/2021 | You | E02D 27/48 |

FOREIGN PATENT DOCUMENTS

| | | |
|---|---|---|
| CN | 105924044 | 9/2016 |
| CN | 106759424 | 5/2017 |
| CN | 207228186 | 4/2018 |
| CN | 108343102 | 7/2018 |
| CN | 208501762 | 2/2019 |
| JP | 2005213904 | 8/2005 |
| JP | 2010180633 | 8/2010 |
| KR | 101678950 | 11/2016 |

* cited by examiner

PILE FOUNDATION BEARING PLATFORM SETTLEMENT, REINFORCEMENT, LIFT-UP AND LEVELING STRUCTURE, AND CONSTRUCTION METHOD THEREOF

CROSS-REFERENCE TO RELATED APPLICATION

The present application is a continuation of international application of PCT application serial No. PCT/CN2019/084388 filed on Apr. 25, 2019, which claims the priority benefit of China application No. 201810385674.6 filed on Apr. 26, 2018. The entirety of each of the above mentioned patent applications is hereby incorporated by reference herein and made a part of this specification.

BACKGROUND

Technical Field

The present application relates to the technical field of building facilities, and more particularly to a pile foundation bearing platform settlement, reinforcement, lift-up and leveling structure, and a construction method thereof.

Description of Related Art

In the field of housing construction and industrial buildings and before construction, it is necessary to treat a backfill soil layer or a soft foundation with a large depth. Under the condition that there is no natural foundation, most buildings need to be piled to serve as a foundation, and then an upper building structure is constructed. In the field of bridges, a pile foundation bearing platform structure is also a main form of a bridge foundation. Due to the fact that foundation treatment is not compact, a foundation soil layer has large compressibility and the bearing capacity of a foundation is insufficient; or, as the drainage condition of the underground water changes, the underground water erosion phenomenon is formed and the foundation bearing capacity is reduced; or, because a weak interlayer exists between the pile tip and the bedrock, or the inclination of the rock surface is large, or a rock-socketed depth of the pile tip is insufficient, sideslip is caused; or, uneven settlement of the pile foundation is caused by factors such as loose soil layer around the pile and low soft friction coefficient. As a result, lift-up and leveling of the bearing platform, and pressure-grouting reinforcement of the pile tip bearing stratum are needed, so as to achieve the requirements of the foundation bearing force and allow the bearing platform to be within a designed allowable settlement deviation range, reduce the height difference between building pile foundations, and guarantee the structural safety of a plant, a house or a bridge.

SUMMARY

Embodiments of the present application are to provide a pile foundation bearing platform settlement, reinforcement, lift-up and leveling structure, and a construction method thereof.

The embodiments of the present application provide the technical solutions as follows:

A pile foundation bearing platform settlement, reinforcement, lift-up and leveling structure, including:

a bearing platform and a plurality of pile foundations fixedly connected to a lower portion of the bearing platform;

the structure further includes a weak soil reinforcement layer under the bearing platform and a pile tip bearing stratum, the bearing platform is located above the weak soil reinforcement layer, the weak soil reinforcement layer is formed with a plurality of first grouting holes, and each of the plurality of the first grouting hole extends through the bearing platform and communicates with the outside, the first grouting hole is used to perform primary grouting in the weak soil reinforcement layer so as to reinforce the weak soil reinforcement layer under the bearing platform, and an upward counter force is formed under a grouting pressure to slowly lift up the bearing platform to a designed allowable deviation range;

the pile tip bearing stratum is located below the weak soil reinforcement layer, the pile tip bearing stratum is formed with a plurality of second grouting holes, and each of the plurality of the second grouting hole extends through the weak soil reinforcement layer and the bearing platform, and communicates with the outside. The second grouting hole is used to perform secondary grouting in the pile tip bearing stratum, so as to form a composite foundation for lifting the pile foundation.

Preferably, the plurality of first grouting holes and the plurality of second grouting holes are uniformly and symmetrically arranged, respectively.

Preferably, the hole diameter of the first grouting hole and that of the second grouting hole are both 42 mm.

Preferably, the slurry adopted for the primary grouting and the secondary grouting is two-component slurry, and the two-component slurry is pressed into a soil body at a slurry outlet of a grouting pipe and converged to react and solidify, and the initial setting time is 5 seconds to 60 seconds.

A construction method of a pile foundation bearing platform settlement, reinforcement, lift-up and leveling structure, the method includes the steps of:

determining hole sites and numbers of grouting holes, wherein the hole sites are symmetrically arranged on the two sides of the pile foundation, and a plurality of grouting holes are provided;

drilling holes at all the hole sites by using a drilling rig to form a plurality of first grouting holes, wherein, after the plurality of first grouting holes are formed, drilling and grouting all-in-one machines are respectively used to simultaneously perform primary grouting in the weak soil reinforcement layer, through the plurality of first grouting holes, in a manner of drilling and grouting in sections, until the bearing platform is slowly and uniformly lifted up to be within an allowable deviation range;

after the bearing platform is stable, continuing, by all the drilling and grouting all-in-one machines, to drill downward to a lower end of the pile foundation to form a plurality of second grouting holes;

after the plurality of second grouting holes are formed, simultaneously performing secondary grouting in a pile tip bearing stratum through the plurality of second grouting holes by respectively using drilling and grouting all-in-one machines, until a concave composite foundation for lifting the pile foundation is formed.

Preferably, the grouting in sections used for the primary grouting comprises a first grouting section, a second grouting section, a third grouting section and a fourth grouting section. The first grouting section is 2 meters in depth, and the second grouting section, the third grouting section and the fourth grouting section are all 1 meter in depth.

Preferably, an initial setting time of a composite grouting slurry used in the primary grouting is 10 seconds to 20 seconds, and a diffusion radius of the grouting slurry is 1.5 meters to 2.0 meters.

Preferably, a grouting pressure of the primary grouting is 0.8 MPa to 1.5 MPa.

Preferably, an initial setting time of a composite grouting slurry used in the secondary grouting is 20 seconds to 40 seconds, and a diffusion radius of the grouting slurry is 2.0 meters to 3.0 meters.

Preferably, a grouting pressure of the secondary grouting is 0.6 MPa to 1.2 MPa.

The present application has the following effects:

The reinforcement and lift-up method is used for construction. Specifically, new technological processes, such as "lift-up and leveling of the bearing platform", and "consolidation reinforcement of the pile tip bearing stratum" are comprehensively applied, the lower portion of the bearing platform forms an enlarged composite foundation bearing body, and the strength of the pile tip bearing stratum is increased, so that the upper load can be uniformly transmitted to the bearing stratum. Technical solutions according to the present application successfully solves the objectives of pile foundation bearing platform settlement, lift-up and leveling, so as to achieve the requirements of the foundation bearing force and allow the bearing platform to be within a designed allowable settlement deviation range. The present application has the advantages of small construction working surfaces and no interference construction, and improved the foundation bearing force and lift-up and leveling dual effects.

Of course, any of the products implementing the present application does not necessarily need to simultaneously achieve all of the advantages described above.

BRIEF DESCRIPTION OF THE DRAWINGS

To make the technical solutions of the present application or the prior art more clearly, the following provides the accompanying drawings used in description of the embodiments of the present application. Apparently, the accompanying drawings show certain embodiments of the application, which are illustrative rather than exhaustive, and persons skilled in the art can derive other drawings from them without creative efforts.

DESCRIPTION OF THE EMBODIMENTS

The technical solutions in the embodiments of the present application are hereinafter described clearly and completely with reference to the accompanying drawings in the embodiments of the present application. Obviously, the embodiments described here are only a part of the embodiments of the application, rather than all of the embodiments. Based on the embodiments of the invention, other embodiments obtained by persons skilled in the art are within the scope protected by the present application.

Example

Figure 1:
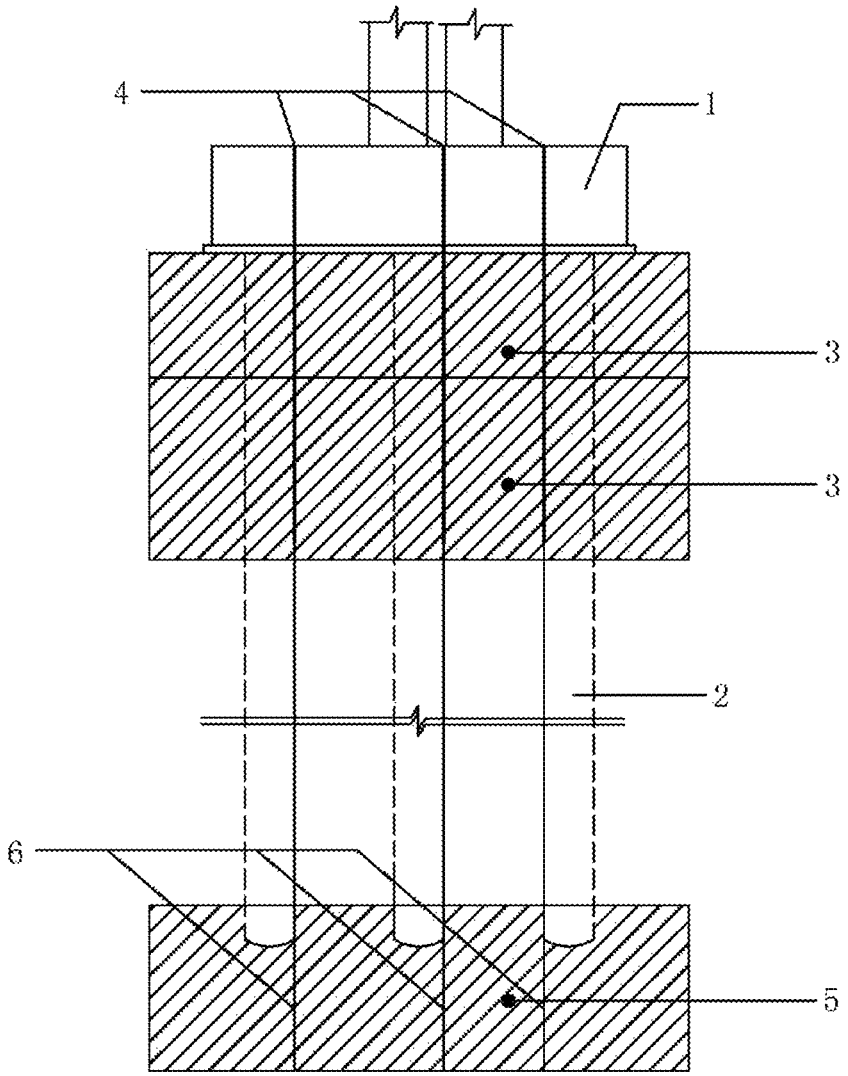
FIG. 1 is a schematic structural diagram of a pile foundation bearing platform settlement, reinforcement, lift-up and leveling structure according to an embodiment of the present application.
Figure 2:
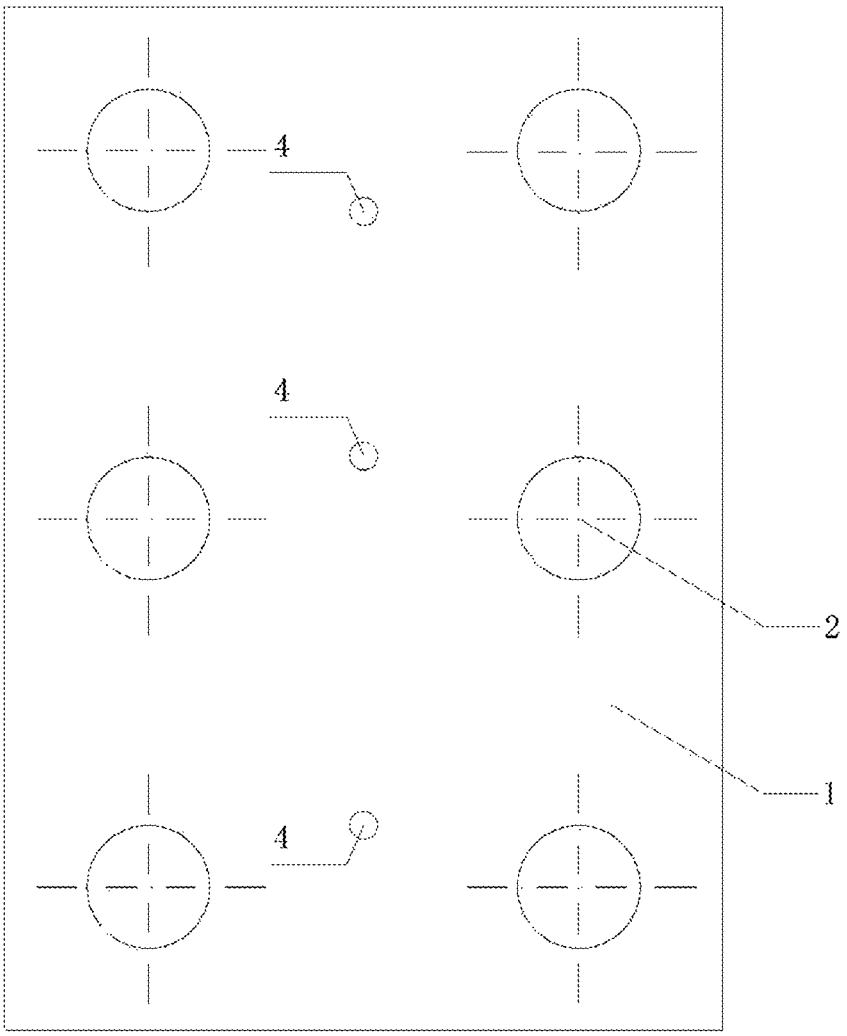
FIG. 2 is a top view of a pile foundation bearing platform settlement, reinforcement, lift-up and leveling structure according to an embodiment of the present application.

Referring to FIG. 1 and FIG. 2, there is provided a pile foundation bearing platform settlement, reinforcement, lift-up and leveling structure according to an embodiment of the present application. The structure includes a bearing platform 1 and a plurality of pile foundations 2 fixedly connected to a lower portion of the bearing platform 1. The structure further includes: a weak soil reinforcement layer 3 under the bearing platform and a pile tip bearing stratum 5. The bearing platform 1 is located above the weak soil reinforcement layer 3 under the bearing platform. The weak soil reinforcement layer 3 under the bearing platform is formed with a plurality of first grouting holes 4, and the first grouting hole 4 extends through the bearing platform 1 and communicates with the outside. The first grouting hole 4 is used to perform primary grouting in the weak soil reinforcement layer 3 under the bearing platform so as to reinforce the weak soil reinforcement layer 3 under the bearing platform, and to form an upward counter force to slowly lift up the bearing platform 1 to a designed allowable deviation range. The pile tip bearing stratum 5 is located below the weak soil reinforcement layer 3 under the bearing platform. The pile tip bearing stratum 5 is formed with a plurality of second grouting holes 6. The second grouting hole 6 extends through the weak soil reinforcement layer 3 under the bearing platform and the bearing platform 1, and communicates with the outside. The second grouting hole 6 is used to perform secondary grouting in the pile tip bearing stratum 5, so as to form a concave composite foundation for lifting the pile foundation 2.

Furthermore, the plurality of first grouting holes and the plurality of second grouting holes are uniformly and symmetrically arranged, respectively. The hole diameter of the first grouting hole and that of the second grouting hole are both 42 mm. The slurry adopted for compaction grouting and pressure-grouting reinforcement is two-component slurry, and the slurry with different components is pressed into a soil body at a slurry outlet of a grouting pipe and converged to react and solidify, and the initial setting time is 5 seconds to 60 seconds.

There is also provided a construction method of a pile foundation bearing platform settlement, reinforcement, lift-up and leveling structure according to an embodiment of the present application. The method includes the following steps.

Hole sites and numbers of grouting holes are determined, wherein the hole sites are symmetrically arranged on the two sides of the pile foundation. A plurality of grouting holes are provided, wherein the specific number of the grouting holes is selected according to the size of the bearing platform and can be 2 to 4, and the number of the grouting holes can be correspondingly increased to 10 to 20 when the grouting holes are used in a bridge bearing platform, especially a bridge bearing platform of a high-speed rail.

Holes are drilled at all the hole sites by using a dedicated drilling rig to form a plurality of first grouting holes, wherein, after the plurality of first grouting holes are formed, drilling and grouting all-in-one machines are respectively used to simultaneously perform primary grouting in the weak soil reinforcement layer, through the plurality of first grouting holes, in a manner of drilling and grouting in sections, until the bearing platform is slowly and uniformly lifted up to be within an allowable deviation range. Lift-up and leveling elevation control of the bearing platform is performed as below. A relative reference standard elevation line is set according to a lift-up standard, elevation monitoring is performed according to the relative reference elevation line, real-time monitoring is performed using a high-precision level instrument and a horizontal laser instrument, and the deviation between the lift-up standard and the required lift-up height is within ±10 mm.

After the bearing platform is stable, all the drilling and grouting all-in-one machines continues to drill downward to a lower end of the pile foundation to form a plurality of second grouting holes;

after the plurality of second grouting holes are formed, drilling and grouting all-in-one machines are respectively used to simultaneously perform secondary grouting in a pile tip bearing stratum, through the plurality of second grouting holes, in a manner of drilling and grouting in sections, until the pile tip bearing stratum forms a composite foundation for lifting the pile foundation. Perpendicularity of a plant frame column or a bridge pier is observed as below. In the lift-up, leveling and reinforcing process of the bearing platform, a precise theodolite is adopted to observe the perpendicularity of the frame columns or the piers in real time, and cross observation is conducted in two directions, to avoid the inclination phenomenon.

Furthermore, the grouting in sections used for the primary grouting comprises a first grouting section, a second grouting section, a third grouting section and a fourth grouting section. The first grouting section is 1 meter to 2 meters in depth, and the second grouting section, the third grouting section and the fourth grouting section are all 1 meter in depth. The initial setting time of a slurry used in the primary grouting is 10 seconds to 20 seconds, and a diffusion radius of the grouting slurry is 1.5 meters to 2.0 meters. The grouting pressure of the primary grouting is 0.8 MPa to 1.5 MPa.

Furthermore, the initial setting time of a slurry used in the secondary grouting is 20 seconds to 40 seconds, and the diffusion radius of the grouting slurry is 2.0 meters to 3.0 meters. A grouting pressure of the primary grouting is 0.6 MPa to 1.2 MPa.

The grouting slurry used for the primary grouting and the secondary grouting can be any one of the slurries in the prior art as long as the slurries satisfy the requirements of the initial setting time and has a good permeability.

Furthermore, in order to prevent the grouting slurry from setting in the pipe, a two-component composite slurry, i.e., Slurry A and Slurry B, is adopted. The two kinds of slurry respectively arrive at a slurry outlet of a grouting pipe from different channels of the drill rod, press the slurry with different components into a soil body at the slurry outlet and converge to react and solidify, and complete initial setting within a short time.

The following slurry formulation can be used: Slurry A is composed of the following raw materials in parts by weight: 70 parts to 90 parts of metal oxide and/or metal hydroxide, 0.5 parts to 1.2 parts of composite retarder, 0.5 parts to 0.7 parts of water reducing agent, 0.7 parts to 1.5 parts of acid base buffer, 3 parts to 5 parts of composite stabilizer, and 0.5 parts to 1.5 parts of composite surfactant. The metal oxide can be a combination of any two of magnesium oxide, aluminum oxide, magnesium phosphate, and the like. The composite retarder is at least two of urea, borax and sodium tripolyphosphate. The water reducing agent can be a polycarboxylic acid water reducing agent or a naphthalene water reducing agent. The acid base buffer is magnesium carbonate or potassium hydroxide. The composite stabilizer is at least two of hydroxymethyl cellulose, n-alkyl hexadecanol, starch ether and cellulose ether. The composite surfactant is at least two of polyoxyethylene alkyl ether, benzylphenol polyoxyethylene ether and alkyl sulfonate. When two or more different materials are to be used in each of the above individual components, materials in equal order of magnitude can be formulated, and the two materials are mainly used for preventing one of the materials from losing efficacy, so that the effect of the whole composite slurry is more stable.

Slurry B is composed of the following raw materials in parts by weight: 30 parts to 40 parts of phosphate, and 0.2 parts to 1 part of defoaming agent. The phosphate can be diammonium hydrogen phosphate or potassium dihydrogen phosphate. The defoaming agent can be an organosilicon defoaming agent or a polyether defoaming agent.

Slurry A and Slurry B are respectively mixed with water in a weight ratio of 100:40-100:50 and stirred into a slurry, and pressed into a slurry pipe via different pipelines, and converged at a slurry outlet to react and solidify into a soil body.

The difference of the initial setting time of the composite slurry is mainly realized by adjusting the specific gravity of the composite retarder.

The technical solutions according to the present application aims to generate an uneven settlement based on a pile foundation with a bearing platform of an existing building, and provide a pile foundation bearing platform settlement, reinforcement, lift-up and leveling technology. The reinforcement and lift-up method is used for construction. Specifically, new technological processes, such as "lift-up and leveling of the bearing platform", and "consolidation reinforcement of the pile tip bearing stratum" are comprehensively applied, the lower portion of the bearing platform forms an enlarged composite foundation bearing body, and the strength of the pile tip bearing stratum is increased, so that the upper load can be uniformly transmitted to the bearing stratum. Technical solutions according to the present application successfully solves the objectives of pile foundation bearing platform settlement, lift-up and leveling in an industrial plant, or a bridge, so as to achieve the requirements of the foundation bearing force and allow the bearing platform to be within a designed allowable settlement deviation range.

It should be pointed out that, for grouting reinforcement in the prior art, due to the fact that a bearing platform, the bottom of a pile foundation and surrounding soil can be softened after grouting, the initial setting time of grouting is long, and before grouting liquid is not solidified, the bearing platform and the pile foundation can settle faster. However, according to the technical solutions of the present application, settlement of the bearing platform in the grouting process is effectively prevented by means of the properties of rapid solidification and good permeability of the grouting slurry. When the bearing platform is lifted in the primary grouting, due to the fact that rapidly-solidified slurry is continuously grouted into the soil layer, the surrounding soil body is pressed, and the bearing platform is lifted as the slurry is continuously grouted and solidified.

The technical solutions of the present application are achieved by the following: 1) the lift-up and leveling of the bearing platform: firstly, the weak soil layer under the bearing platform of the pile foundation is reinforced by compaction grouting, the slurry is filled and densified, so as to improve the density and strength of the weak soil layer, increase the wrapping force of the soil layer around the pile to the pile, and then the grouting pressure is appropriately increased, an upward counter force is formed, to slowly lift up the bearing platform of the pile foundation to a designed allowable deviation range. 2) Pressure-grouting reinforcement of the pile tip bearing stratum: after the lift-up and leveling of the bearing platform, a weak interlayer will exist between the pile tip and the pile tip bearing stratum. After the composite foundation of the bearing platform is solidified and formed with strength, continue to drill downward to the pile tip bearing stratum, and reinforce the pile tip bearing stratum by pressure-grouting, so as to avoid the resettlement of the pile foundation again. The objectives of lifting up, leveling and stabilizing of the foundation are achieved.

The technical solutions of the present application are achieved by the following steps: 1) a reinforced concrete detector is adopted and mainly used for detecting the distribution condition of bearing platform steel bars, and the steel bars are avoided when holes are formed, avoiding damage to the steel bars during hole-defining. 2) Holes (2-4 hole sites arranged) are arranged symmetrically on both sides of the pile foundation, and a dedicated drilling rig, which can be a water drill, is selected to form holes with a diameter of 42 mm. 3) After the holes are formed, a drilling and grouting all-in-one machine is selected to perform drilling and grouting in a weak soil stratum to slowly lift up the bearing platform of the pile foundation to an allowable deviation range. 4) After the bearing platform is stable, holes are continuously drilled downward to the pile tip, and the pile tip bearing stratum is reinforced by pressure-grouting, thereby increasing the bearing force of the pile tip bearing stratum.

According to the solutions of the present application, the overall construction process is drilling and grouting integrated advancing type layered grouting reinforcement and lift-up, and the reinforcement depth is layered downward from shallow to deep. The first grouting section is 1.0 m to 2.0 m, and in the first grouting section, the high-pressure is applied to lift up and level the bearing platform. The second grouting section to the fourth grouting section are about 1.0 m respectively, and mainly used to reinforce a soft soil layer around a pile, stabilize a bearing platform and increase the wrapping force of the soil layer around the pile to the pile. Finally, the holes are drilled to the pile tip bearing stratum, so as to reinforce the weak interlayer between the pile tip and the pile tip bearing stratum by pressure-grouting and improve the bearing force of the pile tip bearing stratum. After the first grouting section is completed, the layered drilling and grouting is continuously performed, downward and sectionally, so as to complete reinforcement, lift-up and leveling of the pile foundation. The hole sites provided in the present application are arranged symmetrically and drilled simultaneously to avoid pile foundation deviation caused by uneven force during pressure grouting.

According to the technical solutions provided in the present application, the drilled holes have a diameter of 42 mm. Small-diameter holes have less damage and are easy to recover. The construction working surfaces are small, dual effects of improving the foundation bearing force and lift-up and leveling can be achieved without influencing normal operation.

It should be noted that the relational terms, such as first and second, and the like as used herein are used solely to distinguish one entity or operation from another entity or operation, and do not necessarily require or imply that there is any such actual relationship or order between these entities or operations. Besides, the terms "comprise", "include" or any variations thereof as used herein are intended to cover a non-exclusive inclusion, such that a process, method, article, or device that comprises a list of elements does not include only those elements but may include other elements not expressly listed or inherent to such process, method, article, or device. An element proceeded by "comprises a", without more constraints, does not preclude the existence of additional identical elements in the process, method, article, or apparatus that comprises the element.

These embodiments are merely explanatory and are not restrictive of the application. After reading this specification, those skilled in the art can make various modifications to the embodiments as needed without creative work, which falls within the protection scope defined by the appended patent claims.

What is claimed is:

1. A pile foundation bearing platform settlement, reinforcement, lift-up and leveling structure, comprising: a bearing platform and a plurality of pile foundations fixedly connected to a lower portion of the bearing platform, and further comprising: a weak soil reinforcement layer under the bearing platform and a pile tip bearing stratum, wherein the bearing platform is located above the weak soil reinforcement layer; the weak soil reinforcement layer is formed with a plurality of first grouting holes, and each of the plurality of first grouting holes extends through the bearing platform and communicates with the outside; each of the plurality of first grouting holes is used to perform primary grouting in the weak soil reinforcement layer so as to reinforce the weak soil reinforcement layer, and an upward counter force is formed under a grouting pressure to slowly lift up the bearing platform to a designed allowable deviation range; the pile tip bearing stratum is located below the weak soil reinforcement layer; the pile tip bearing stratum is formed with a plurality of second grouting holes, and each of the plurality of second grouting holes extends through the weak soil reinforcement layer and the bearing platform, and communicates with the outside; each of the plurality of second grouting holes is used to perform secondary grouting in the pile tip bearing stratum, so as to form a composite foundation for lifting the pile foundation; and wherein the plurality of first grouting holes and the plurality of second grouting holes are uniformly and symmetrically arranged on the two sides of the pile foundation, respectively.

2. The pile foundation bearing platform settlement, reinforcement, lift-up and leveling structure according to claim 1, wherein a hole diameter of each of the plurality of first grouting holes and a hole diameter of each of the plurality of second grouting holes are both 42 mm.

3. The pile foundation bearing platform settlement, reinforcement, lift-up and leveling structure according to claim 1, wherein slurry adopted for the primary grouting and the secondary grouting is two-component slurry, and the two-component slurry is pressed into a soil body at a slurry outlet of a grouting pipe and converged to react and solidify, and an initial setting time is 5 seconds to 60 seconds.

4. A construction method of the pile foundation bearing platform settlement, reinforcement, lift-up and leveling structure according to claim 1, comprising steps of:

determining hole sites and numbers of grouting holes, wherein a plurality of grouting holes are provided;

drilling holes at all the hole sites by using a drilling rig to form the plurality of first grouting holes, wherein after the plurality of first grouting holes are formed, drilling and grouting all-in-one machines are respectively used to simultaneously perform the primary grouting in the weak soil reinforcement layer, through the plurality of first grouting holes, in a manner of drilling and grouting in sections, until the bearing platform is slowly and uniformly lifted up to be within an allowable deviation range;

after the bearing platform is stable, continuing, by all the drilling and grouting all-in-one machines, to drill downward to a lower end of the pile foundation to form the plurality of second grouting holes; and after the plurality of second grouting holes are formed, simultaneously performing the secondary grouting in a pile tip bearing stratum through the plurality of second grouting holes, in a manner of drilling and grouting in sections, by respectively using drilling and grouting all-in-one machines, until a concave composite foundation for lifting the pile foundation is formed.

5. The construction method of the pile foundation bearing platform settlement, reinforcement, lift-up and leveling structure according to claim 4, wherein the grouting in sections used for the primary grouting comprises a first grouting section, a second grouting section, a third grouting section and a fourth grouting section; the first grouting section is 2 meters in depth, and the second grouting section, the third grouting section and the fourth grouting section are all 1 meter in depth.

6. The construction method of the pile foundation bearing platform settlement, reinforcement, lift-up and leveling structure according to claim 5, wherein an initial setting time of a composite grouting slurry used in the primary grouting is 10 seconds to 20 seconds, and a diffusion radius of the grouting slurry is 1.5 meters to 2.0 meters.

7. The construction method of the pile foundation bearing platform settlement, reinforcement, lift-up and leveling structure according to claim 6, wherein a grouting pressure of the primary grouting is 0.8 MPa to 1.5 MPa.

8. The construction method of the pile foundation bearing platform settlement, reinforcement, lift-up and leveling structure according to claim 4, wherein an initial setting time of a composite grouting slurry used in the secondary grouting is 20 seconds to 40 seconds, and a diffusion radius of the grouting slurry is 2.0 meters to 3.0 meters.

9. The construction method of the pile foundation bearing platform settlement, reinforcement, lift-up and leveling structure according to claim 8, wherein a grouting pressure of the secondary grouting is 0.6 MPa to 1.2 MPa.

* * * * *